United States Patent [19]

Herd et al.

[11] 4,455,242

[45] Jun. 19, 1984

[54] REDUCING THE CLOUD POINT OF HYDRODEWAXED BASE STOCKS

[75] Inventors: Richard S. Herd; Phillip S. Landis, both of Woodbury, N.J.

[73] Assignee: Mobil Oil Corporation, New York, N.Y.

[21] Appl. No.: 456,879

[22] Filed: Jan. 10, 1983

[51] Int. Cl.[3] ..... C10M 1/38; C10M 1/54

[52] U.S. Cl. ..... 252/40.7; 252/31; 252/46.4; 252/45; 208/18; 208/19

[58] Field of Search ..... 252/40.7, 45, 46.4, 252/31; 208/18, 19

[56] References Cited

U.S. PATENT DOCUMENTS

| | | | |
|---|---|---|---|
| 2,147,155 | 2/1939 | Gardner | 252/40.7 |
| 2,669,560 | 2/1954 | Sperry | 252/31 |
| 4,125,471 | 11/1978 | Vienna et al. | 252/45 |

*Primary Examiner*—Jacqueline V. Howard

*Attorney, Agent, or Firm*—Alexander J. McKillop; Michael G. Gilman; Claude E. Setliff

[57] ABSTRACT

The cloud point of a hydrodewaxed base stock is reduced by direct sulfurization of the base stock, or by direct sulfurization of the base stock in the presence of a magnesium compound.

10 Claims, No Drawings

REDUCING THE CLOUD POINT OF HYDRODEWAXED BASE STOCKS

BACKGROUND OF THE INVENTION

1. Field of the Invention

This invention concerns a method for reducing the cloud point and the hazing characteristics of a hydrodewaxed base stock. More particularly, it relates to a method of lowering the cloud point (particularly the overnight cloud point) of a base stock by treating same with a sulfurizing agent, either alone or in the presence of an oil-soluble magnesium, calcium or barium compound or a combination thereof, and adding a cloud point reducing amount of the sulfurized base stock to the untreated base stock. It will be understood that the method is applicable to reducing the cloud and the hazing characteristics, or the two in the alternative.

2. Discussion of the Prior Art

Many hydrodewaxed base oils have relatively high cloud points. While other properties are excellent and the cloud point appears to have no deleterious effect on the performance of formulated oils, nevertheless there are specification tests for many oils that require that there be no overnight cloud formation in the base oil at a given temperature.

The high cloud point (or overnight cloud point, ONC) is common to many hydrodewaxed oils. Much processing work, such as selective removal of the haze components and use of crystallization inhibitors, has been done with limited success. Generally, solutions to the haze formation are uneconomic or impractical because the solutions introduce other problems such as lower viscosity index, water emulsification tendency, poorer oxidation response, and the like.

While it is known to use phosphorus- and sulfur-containing compounds as additives to oils, no prior art is known that teaches or suggests that useful results can be obtained by reacting a mineral oil base stock with sulfur and compounding an additive amount thereof with an unreacted base stock. While the exact nature of the compounds formed by sulfurization leading to large improvement is not known, it is believed that various sulfide, disulfide and polysulfide linkages are formed which interface with the wax crystal growth.

Sulfurizing mineral oils is an old art. Such sulfurization is used to stabilize the oils against oxidation and to provide antiwear activity.

SUMMARY OF THE INVENTION

In accordance with the invention, there is provided a method for lowering the cloud point of a hydrodewaxed mineral oil base stock which comprises reacting sulfur therewith in proportions to provide from about 0.10% to about 1.0% by weight thereof in said oil and adding this to the mentioned mineral oil base stock, such that a sulfur content of from about 0.01% to about 0.20% by weight thereof in the total oil-additive composition is attained. Alternatively, if color is a problem, sulfurization may be carried out in the presence of an oil-soluble metal compound, i.e., a calcium, barium or magnesium compound. It is preferred that the metal compound be present during reaction with sulfur, because a principal value of the invention is to provide a product with a light color. There is further evidence that the presence of the metal compounds also aids in improving the hazing characteristics of the oil. The invention also provides a lubricant composition comprising lubricant and the oil-sulfur product, whether comprising a metal compound or not.

DESCRIPTION OF SPECIFIC EMBODIMENTS

The method disclosed herein is generally applicable to any hydrodewaxed mineral oil susceptible to haze formation at lower temperatures. Although, as has been stated hereinabove, such haze formation does not affect other properties of the oil, specifications have been established in some companies which require oils to pass an overnight cloud point of 30° F. Other companies may set higher temperatures, e.g., 40° F.

In carrying out the method, oil is mixed with sufficient sulfur to provide from about 0.10% to about 1.0% thereof in the oil, and the mixture is heated at from about 150° C. to about 250° C., preferably from about 180° C. to about 200° C. until the reaction is complete. The reaction typically will require from 1 to 5 hours. Alternatively, a metal compound may be present in the oil during reaction. The metal compound is used in small amounts, usually on the order of from about 0.01% to about 1.0%, and preferably about 0.05% to 0.5%, based on the weight of the oil. The amount of compound used will depend upon the degree of haze improvement required, i.e., heavy haze will require more of the sulfur component than trace or light haze. Also, the amount of sulfur will dictate reaction times—longer times will be required for higher loads of sulfur.

During the reaction between oil and sulfur, hydrogen sulfide is formed. To remove this by-product, oxygen, nitrogen or other inert gas is blown through or over the medium.

The haze component is present in the oil in very small amounts, often less than 0.1% by weight of the oil. We believe that equally small amounts of sulfur compounds formed in the oil are effective because the sulfur reacts in part with organic structures present to produce small amounts of organo-sulfur compounds, which in turn solubilize the haze component and prevent its crystallization at a given lower temperature.

One specific problem area is with Aldelaide MLDW bright stock, having the properties:

| | | |
|---|---|---|
| SUS @ 210° F. | = | 150 |
| VI | = | 95 |
| Pour Point | = | 20° F. |
| CCR | = | 1.1% |
| % S | = | 1.2 |
| ASTM Color | = | 2.5 |

This oil, without the sulfur compound, produces a visible haze on storage overnight at 30° F., which disappears at higher temperatures (but which will reform on cooling again). Several compounds were tested as solubilizers for the haze component, but only a few showed any effect at all. However, such high concentrations of these were required that their use was economically impracticable. Further, the high concentrations required introduced other undesirable properties to the base fluid.

Candidates from several categories of chemical types were tested as solubilizers for the haze component, but only a few showed any effect at all. Those showing an effect are economically impracticable, however, because of the high concentrations required. Those having some effect were:

dioctyl sulfide didodecyl sulfide
dimethyl disulfide
sulfurized butene-1
sulfurized cis-butene-2
sulfurized trans-butene-2
sulfurized mixed butenes
sulfurized octene
sulfurized decene
sulfurized decene dimer Di-t-butyl disulfide showed somewhat more improvement than those listed hereinabove.

Having described the invention in general terms, the following Examples are offered as specific embodiments. It will be understood that they are illustrative of the invention and are not intended to limit its scope.

EXAMPLE 1

Eighty-four grams of Adelaide MLDW Bright Stock and 0.084 grams of sulfur were charged into a 250 ml, 4 neck round bottom flask equipped with a thermometer, glass "paddle" stirrer and nitrogen inlet tube. The contents were heated to 180° C. and held for 2 hours with a stream of nitrogen above surface. The sulfurized product was cooled to 90° C. and filtered through diatomaceous earth.

The product contained 0.1% sulfur.

EXAMPLE 2

Ninety-nine and eight tenths grams of Adelaide MLDW Bright Stock and 0.2 grams of sulfur were charged into a 250 ml, 4 neck round bottom flask equipped with a thermometer, glass "paddle" stirrer and nitrogen inlet tube. The contents were heated to 200° C. and held for 2 hours with a stream of nitrogen above surface. The sulfurized product was cooled to 90° C. and filtered through diatomaceous earth.

The product contained 0.2% sulfur.

EXAMPLE 3

Two hundred grams of Adelaide MLDW Bright Stock, 0.4 grams of sulfur and 0.1 grams of magnesium-$C_{10}$ salicylate were charged into a 500 ml, 4 neck round bottom flask equipped with a thermometer, glass "paddle" stirrer and nitrogen inlet tube. The contents were heated to 180° C. and held 2 hours with a stream of nitrogen above surface. The sulfurized product was cooled to 90° C. and filtered through diatomaceous earth.

The product contained 0.2% sulfur and 0.05% of the Mg compound (0.004% Mg).

EXAMPLE 4

Seventy-nine and two tenths grams of Adelaide MLDW Bright Stock, 0.8 grams of sulfur and 0.2 grams of magnesium-$C_{10}$ salicylate were charged into a 125 ml, 2 neck flat bottom flask equipped with a thermometer, magnetic spinbar and nitrogen inlet tube. The contents were heated to 180° C. and held for 2 hours with a stream of nitrogen above surface. The sulfurized product was cooled to 160° C. and then air blown subsurface for 1.5 hours while cooling to 87° C. The air rate is 0.64 CFH. The product was filtered through diatomaceous earth.

This product contained 1% sulfur and 0.25% of the compound (0.0016% Mg).

EXAMPLE 5

Ninety-nine and eight tenths grams of Adelaide MLDW Bright Stock, 0.2 gram of sulfur and 0.05 gram of a magnesium-$C_{10}$ salicylate were charged into a 125 ml., 2 neck flat bottom blash equipped with a thermometer, magnetic spin bar and a nitrogen inlet tube. The contents were heated to 200° C. and held for 2 hours with a stream of nitrogen above surface. The sulfurized product was cooled to 150° C. and then air blown subsurface for 2.5 hours while cooling to 93° C. The air rate was 0.64 CFH. The product was filtered through diatomaceous earth.

This product is similar to Example 3 except the reaction temperature is 200° C. The product contains 0.2% sulfur and 0.05% of a Mg compound (0.064% Mg).

EXAMPLE 6

Ninety-nine and five tenths grams of Adelaide MLDW Bright Stock, 0.4 gram of sulfur and 0.1 gram of a magnesium-$C_{10}$ salicylate were charged into a 125 ml., 2 neck flat bottom flask equipped with a thermometer, magnetic spin bar and a nitrogen inlet tube.

The reaction conditions are the same as for Example 5.

The product contains 0.4% sulfur and 0.1% of a Mg compound (0.008% Mg).

EXAMPLE 7

Ninety-eight and seventy-five hundredths grams of Adelaide MLDW Bright Stock, 1.0 grams of sulfur and 0.25 gram of a magnesium-$C_{10}$ salicylate were charged into a 125 ml., 2 neck flat bottom flask equipped with a thermometer, magnetic spin bar and a nitrogen inlet tube.

The reaction conditions are the same as for Examples 5 and 6.

The product contains 1% sulfur and 0.25% of a Mg compound(0.02% Mg).

EXAMPLE 8

Ninety-nine grams of Adelaide MLDW Bright Stock and 1.0 grams of sulfur were charged into a 125 ml, 2 neck flat bottom flash equipped with a thermometer, magnetic spin bar and a nitrogen inlet tube.

The reaction conditions are the same as for Example 7.

The product contains 1% sulfur and is the same as Example 7 except no Mg compound is used.

EVALUATION OF OILS

Samples of the oil were heated to 212° F. for 45 minutes and were then placed in a cold room, maintained at 30° F., overnight (actually, for a total of about 16 hours) and were evaluated for haze by nephelometric determination. Numbers higher than 10 indicate visible haze.

Results are shown in the following table.

TA8LE 1

OVERNIGHT CLOUD POINT TEST RESULTS WITH ALDELAIDE MLDW BRIGHT STOCK (HYDRODEWAXED)

| | Wt. % Conc. In Adelaide Bright Stock | Overnight Cloud Point |
|---|---|---|
| Adelaide Bright Stock | — | 33 |
| Example 1 | 10 | 10 |
| Example 2 | 5 | 19 |
| | 10 | 9 |

TA8LE 1-continued

OVERNIGHT CLOUD POINT TEST RESULTS WITH ALDELAIDE MLDW BRIGHT STOCK (HYDRODEWAXED)

| | Wt. % Conc. In Adelaide Bright Stock | Overnight Cloud Point |
|---|---|---|
| Example 3 | 10 | 10 |
| Example 4 | 1 | 17 |
| | 2 | 13 |
| | 4 | 9 |
| Example 5 | 5 | 7 |
| | 10 | 7 |
| Example 6 | 1 | 9 |
| | 5 | 10 |
| Example 7 | 1 | 9 |
| | 2 | 9 |
| Example 8 | 1 | 14 |
| | 2 | 13 |

TABLE 2

VISIBLE CLOUD POINT TEST RESULTS WITH MLDW STOCK(1)

| Additive | Wt. % in MLDW Stock | Observed Haze at 30° F. (Overnight) | ONC 30° C. |
|---|---|---|---|
| None | — | Light Haze | 4 |
| Example 3 | 1.0 | Clear and Bright | 0 |
| Example 3 | 5.0 | Clear and Bright | 0 |
| Example 3 | 10.0 | Clear and Bright | 3 |

(1)100" solvent paraffinic neutral mineral oil.

TABLE 3

CLOUD POINT OBSERVATIONS WITH GULF CANADA HYDRODEWAXED BRIGHT STOCKS

| Additive | Base Oil | Wt. % | Observed Haze at Room Temp. 70° F. | Overnight Cloud, 70° F. |
|---|---|---|---|---|
| None | A, hydrodewaxed 170BS Feed | — | Heavy Haze Overnight | 48 |
| | B, hydrodewaxed 170BS Product | — | Light Haze Overnight | — |
| Example 3 | A | 10 | Clear Overnight | 16 |
| Example 3 | A | 5 | Clear Overnight | 24 |
| Example 3 | A | 2.5 | Trace Haze Overnight | 25 |
| Example 3 | A | 1.0 | Trace Haze Overnight | 22 |
| Example 3 | B | 5 | Clear Overnight | — |
| Example 3 | B | 10 | Clear Overnight | — |
| Example 3 | B | 1 | Trace Haze Overnight | — |

TABLE 4

OVERNIGHT CLOUD POINT TESTS WITH VARIOUS MLDW STOCKS

| Base Stock | Additive | Wt. % Additive | ONC at 30° F. | Observed Haze at 30° F. |
|---|---|---|---|---|
| (2) | — | — | 3 | Haze |
| (2) | Example 3 | 5 | 1 | Bright & Clear |
| (2) | Example 3 | 10 | 0 | Bright & Clear |
| (3) | — | — | 120 | Haze |
| (3) | Example 3 | 5 | 63 | Trace Haze |
| (3) | Example 3 | 10 | 101 | Trace Haze |
| (4) | — | — | 15 | Haze |
| (4) | Example 3 | 5 | 16 | Lt. Haze |
| (4) | Example 3 | 10 | 10 | Bright & Clear |
| (5) | — | — | 13 | Haze |
| (5) | Example 3 | 5 | 7 | Bright & Clear |

TABLE 4-continued

OVERNIGHT CLOUD POINT TESTS WITH VARIOUS MLDW STOCKS

| Base Stock | Additive | Wt. % Additive | ONC at 30° F. | Observed Haze at 30° F. |
|---|---|---|---|---|
| (6) | — | — | 11 | Haze |
| (6) | Example 3 | 5 | 25 | Haze |

(2)—200" solvent paraffinic neutral mineral oil.
(3)—700" solvent paraffinic neutral mineral oil (VI-100; 75 SUS at 210° F.).
(4)—700" solvent paraffinic neutral mineral oil (VI-95, 695 SUS at 210° F.).
(5) and (6)—Highly refined turbine oil stocks.

What is claimed is:

1. A method for lowering the cloud point and/or improving the haze-forming characteristics of a hydrodewaxed mineral oil base stock which comprises reacting sulfur with said base stock in sufficient quantity to provide from about 0.10% to about 1.0% by weight of sulfur therein and adding a sufficient amount of this sulfurized stock to an unreacted mineral oil base stock such that the concentration of sulfur in the total composition is from about 0.01% to about 0.20% by weight.

2. The method of claim 1 wherein there is present during sulfurization from about 0.01% to about 1.0% by weight of an oil soluble calcium, barium or magnesium compound.

3. The method of claim 2 wherein the oil soluble compound is an oil soluble magnesium compound.

4. The method of claim 3 wherein the magnesium compound is magnesium decyl salicylate.

5. The method of claim 1 wherein the reaction takes place at from about 150° C. to about 250° C.

6. A lubricant composition comprising a major proportion of a hydrodewaxed mineral oil base stock and an amount of a hydrodewaxed mineral oil - sulfur reaction product containing from about 0.10% to about 1.0% by weight of sulfur sufficient to give a concentration of sulfur in said composition of from about 0.01% to about 0.2% by weight thereof.

7. The composition of claim 6 wherein there is present the residue of an oil soluble calcium, barium or magnesium compound used in the reaction to form the said reaction product.

8. The composition of claim 7 wherein the oil soluble compound is an oil soluble magnesium compound.

9. The composition of claim 8 wherein the magnesium compound is magnesium decyl salicylate.

10. The composition of claim 6 wherein the reaction to form the said reaction product is carried out at from about 150° C. to about 250° C.

* * * * *